US005248092A

United States Patent [19]

Rankin

[11] Patent Number: 5,248,092

[45] Date of Patent: Sep. 28, 1993

[54] PULSATING SPRAY NOZZLE

[76] Inventor: George J. Rankin, 3620 W. 11th St., Houston, Tex. 77088

[21] Appl. No.: 738,479

[22] Filed: Jul. 31, 1991

[51] Int. Cl.[5] ..... B05B 3/06; B05B 1/08

[52] U.S. Cl. ..... 239/222; 239/251; 239/381

[58] Field of Search ..... 239/222, 251, 381, 214

[56] References Cited

U.S. PATENT DOCUMENTS 5,060,863 10/1991 Hammelmann ..... 239/251

5,096,122 3/1992 Abramoska ..... 239/251

*Primary Examiner*—Andres Kashnikow

*Assistant Examiner*—Karen B. Merritt

*Attorney, Agent, or Firm*—Alton W. Payne

[57] ABSTRACT

A pulsating nozzle which includes a rotating head driven by reaction forces of high pressure water passing through outlets disposed at an angle to a plane normal to the axis about which the head rotates and through a plurality of spaced passages extending partially circumferentially with respect to such axis.

9 Claims, 2 Drawing Sheets

PULSATING SPRAY NOZZLE

BACKGROUND OF THE INVENTION

It has been found that in certain situations it is desirable to provide means to cause a stream of jetted high pressure fluid or water to pulsate rather than to flow in a continuous stream to enhance cleaning or washing operations. While means for causing streams of water to pulsate, such as shower heads, have been generally available, it is believed that in high pressure applications, such as in the range several thousand psi, there is need for a nozzle capable of handling such high pressures.

The apparatus of the present invention provides means to produce a pulsating effect in the output of a high pressure stream and also to provide means for causing the individual pulses to be repeated very rapidly at the rate of several pulses per second.

The present invention also provides means for varying the pulsating rate of the nozzle by changing the pattern of the openings through which the stream passes and, if desired, directing the pulsating streams to either a central point or, if desired, directing them in diverging paths.

It is also an object of the present invention to provide a pulsating nozzle having a rotating head mounted substantially concentrically on a shaft with a fluid film between the shaft and the head for lubricating the shaft and bore to reduce friction, and to include a series of passages either in the shaft or the head to accommodate fluid for such film.

DESCRIPTION OF THE PREFERRED EMBODIMENT

Figure 2:
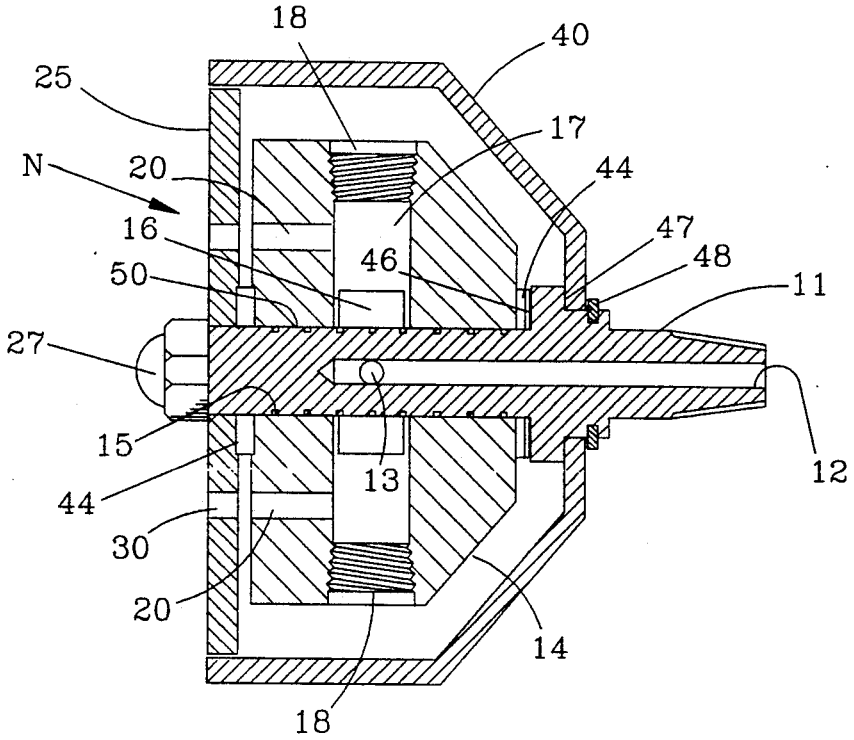
FIG. 2 is a sectional view taken along line A-A of FIG. 1 showing the internal construction details of the rotating head high pressure nozzle of the present invention.

As shown in FIG. 2 of the drawings, the pulsating nozzle of the present invention comprises a hollow shaft 11 having a bore 12 extending longitudinally thereof with a lateral opening 13, being radially extending tubular openings beginning at the interior surface of the hollow bore and extending outward through the wall of the bore communicating high pressure fluid to the counterbore 16 for permitting high pressure fluid to flow through the bore 12 and into the passages in the rotating head 14 that is mounted on the shaft 11. The rotating head 14 includes a central bore or passage 15 with a counterbore 16 extending therearound and communicating with radially extending passages 17. The outer ends of the passages 17 are closed by means of plugs 18 that also provide means for balancing the rotating head to facilitate high speed rotation.

The head 14 also includes a plurality of output passages or jets 20 which are disposed in the head so as to communicate with the radially extending passages 17 and also disposed so as to eject high pressure water out of the front of the head or nozzle N.

It will be appreciated that the passages 20 may be tilted relative to the axis of the shaft 11 so that a reaction force will be produced by high pressure water being injected through such passages 20 and such reaction force will cause the head 14 to spin or rotate rapidly about the shaft 11.

A diffuser plate 25 is provided on the shaft 11 and is positioned adjacent the front of the rotating head 14 and is secured on the shaft 11 by means of a castle nut 27.

Figure 1:
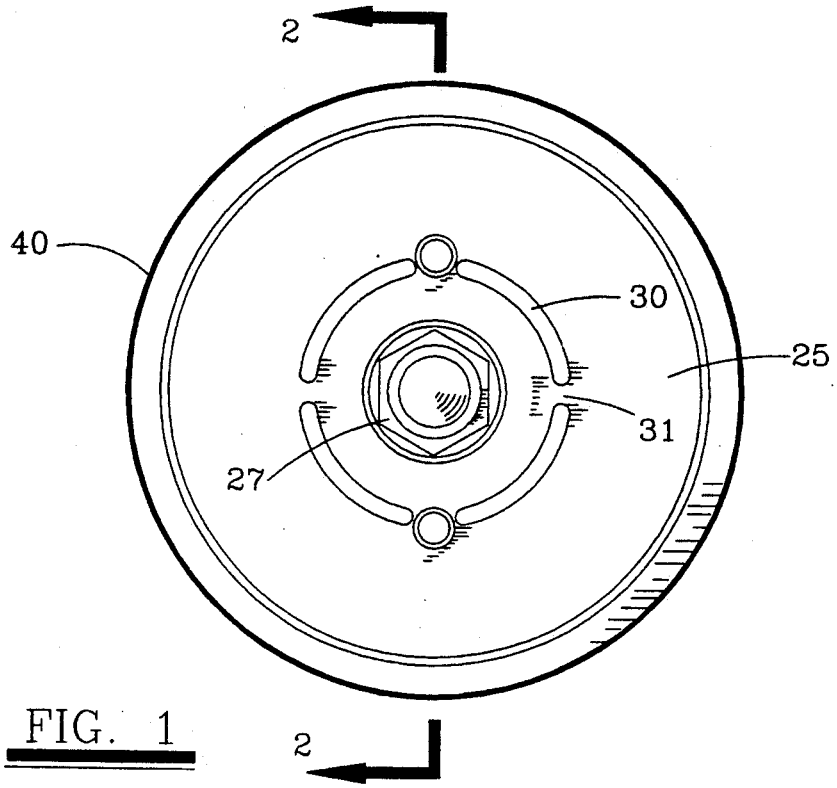
FIG. 1 is an end view of the pulsating nozzle of the present invention showing the arrangement of the spaced circumferentially extending openings through which the high pressure water or fluid is ejected.

As shown in FIG. 1 of the drawings, the diffuser plate 25 is provided with a plurality of circumferentially extending spaced openings or passages 30 which, as shown in FIG. 2, are aligned with the jets or nozzles 20. A web portion 31 is provided between adjacent ends of the passages 30 and is aligned with such passages so that as the nozzles 20 turn on the shaft 11 they will sequentially pass the open passages 30 and the web portions 31 and, of course, the flow of high pressure water outwardly through the openings 30 will be interrupted when the nozzles 20 are aligned with the web portions 31. The web portions 31 will interrupt the flow of water through the nozzles and thereby cause the pulsating effect.

It will be appreciated that while four openings 30 are shown in FIG. 1 of the drawings, that the number of openings may be changed and also the circumferential length of each of the openings may be changed as desired. Thus, the dwell time of the jets and the duration of the intervals between pulsations can be altered to suit the user's convenience.

The diffuser plate 25 is provided with a central opening through which the shaft 11 extends and the castle nut 27 is threaded thereon to hold the diffuser plate in position on the shaft. As shown in the drawings, the diffuser plate has a smaller diameter than the opening in the end of housing 40 which surrounds the rotating head 14 so that the skirt portion of the housing 40 overlaps the outer circumference of the diffuser plate 25. With this arrangement, the diffuser plate is slightly recessed inside the housing 40.

Spacer rings or washers 44 are provided on the shaft 11 on opposite sides of the rotating head 14. The rearward spacer 44 is positioned between the back of the rotating head and an annular shoulder 46 that is provided on the shaft 11.

The rearward spacer 44 is employed to provide correct alignment between the rotating head 14 and the annular shoulder 46 of the shaft. A second annular shoulder 47 is provided for fitting into an opening in the back of the shroud or housing 40 and a clip ring 48 is provided in a groove in the shaft 11 to secure the housing 40 in position against the annular shoulder 47. Also as shown in FIG. 2 of the drawings a labyrinth of passages 50 is provided in that portion of the shaft 11 which extends through the bore 15 of the rotating head 14. This labyrinth of passages allows a film of water to be formed between the shaft 11 and the walls of the bore 15 to lubricate the rotating head on the shaft facilitate the high speed rotation of the head.

Figure 3:
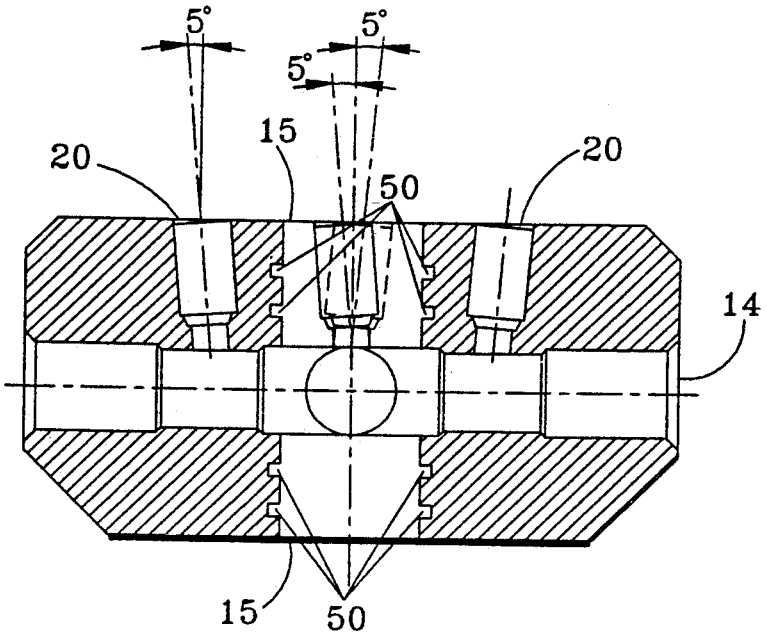
FIG. 3 is a cross-sectional view of the rotating head showing the angular placement of the nozzles, aligned in such a manner as to impart rotational movement of the rotating head when high pressure fluid is applied at the inlet of the passages and a labyrinth of fluid passages are included in the bore of the rotating head.
Figure 4:
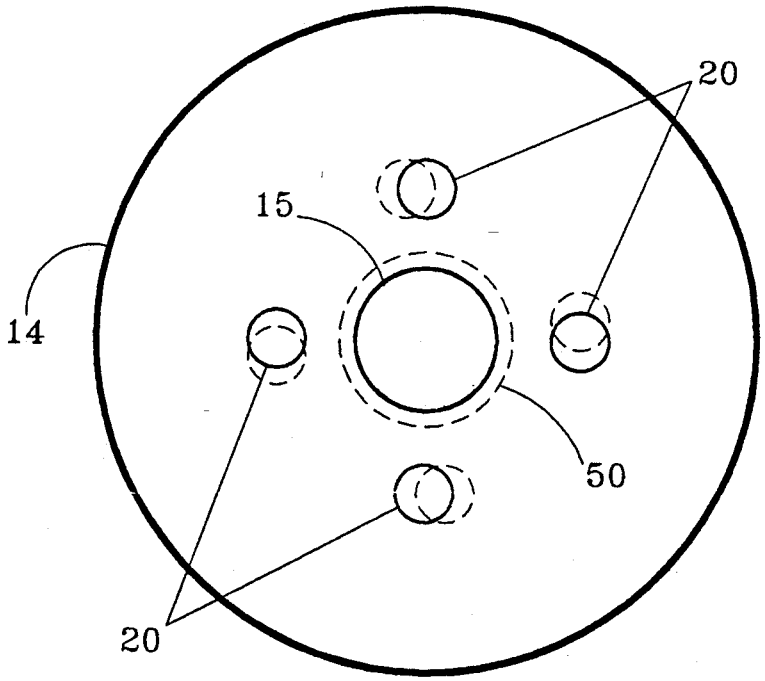
FIG. 4 is a top view of the rotating head showing the angular placement of the nozzles, aligned in such a manner as to impart rotational movement of the rotating head when high pressure fluid is applied at the inlet of the passages and a labyrinth of fluid passages are included in the bore of the rotating head.

Referring now to FIG. 4 of the drawings, a top view of the rotating head 14 is depicted wherein rotating head 14 includes nozzle 20 outlets 21 located on the surface of rotating head 14 illustrated using solid rings and the nozzle 20 inlets 23 located at the contact between the radially extending passages 17 and the nozzles 20 and are illustrated using dashed rings slightly off-center from the outlets 21. In FIG. 4, a top view of rotating head 14 is depicted wherein the labyrinth of fluid passages 50 within the bore 15 of rotating head 14 are illustrated using a dashed ring, shown slightly larger than the bore 15. FIG. 3 further depicts the nozzles 20 which are inclined at a 5 degree angle from vertical and are positioned such that the rotating head rotates when high pressure fluid is applied to the inlets 23 of nozzle 20. Further, FIG. 3 depicts the labyrinth of fluid passages 50 which are positioned laterally, adjacent the bore 15.

Having described the invention above, various modifications of the techniques, procedures, material and equipment will be apparent to those in the art. It is intended that all such variations within the scope and spirit of the appended claims be embraced thereby.

What is claimed is:

1. A pulsating nozzle apparatus comprising:

(a) a central shaft having a longitudinally extending fluid passage therein;

(b) a rotating head mounted to revolve about said shaft with a counterbore therein for communicating with the fluid passage in said central shaft;

(c) at least one radially extending passage in said rotating head communicating with the counterbore;

(d) a lateral opening within said central shaft adjacent to the counterbore wherein high pressure fluid in the central shaft can communicate directly with the counterbore and said at least one radially extending passage in the rotating head;

(e) at least one jet engaged with the rotating head, having direct communication to the high pressure fluid and causing the rotating head to rotate when the high pressure fluid is applied to said rotating head;

(f) means for temporarily obstructing discharge of high pressure fluid from said at least one jet as said rotating head revolves on said central shaft to cause the fluid discharge from the nozzle apparatus to pulsate; and (g) spacer means to align the rotating head on the shaft.

2. The invention of claim 1 including housing means mounted on said central shaft and surrounding said rotating head.

3. The invention of claim 1 wherein said central shaft has a labyrinth of fluid passages thereon adjacent said rotating head for providing a fluid film between said central shaft and said rotating head.

4. The invention of claim 1 wherein said rotating head includes a labyrinth of fluid passages for providing fluid film between said rotating head and said central shaft.

5. The invention of claim 1 wherein said rotating head is made of stainless steel material and said central shaft is made of beryllium copper to provide a non-galling rotating couple.

6. The invention of claim 1 wherein said at least one jet includes a plurality of longitudinally extending passages which are radially spaced relative to the axis of said central shaft.

7. The invention of claim 1 wherein the at least one jet includes a plurality of jets positioned on the rotating head in an angular manner, to create thrust when high pressure fluid engages the jets.

8. A pulsating nozzle apparatus comprising:

(a) a central shaft having a longitudinally extending fluid passage therein;

(b) a housing means mounted on said central shaft;

(c) a rotating head mounted to revolve about said central shaft, and surrounded by said housing means, with a counterbore therein for communicating with the fluid passage in said central shaft;

(d) at least one radially extending passage engaged with said rotating head communicating with the counterbore;

(e) means for temporarily obstructing discharge of high pressure fluid from at least one jet as said rotating head revolves on said central shaft to cause the fluid discharge from the nozzle apparatus to pulsate wherein said means for temporarily obstructing the discharge from said nozzle apparatus includes a plate carried by said shaft, said plate having a plurality of circumferentially extending arcuate shaped apertures therein aligned with the at least one jet in said rotating head;

(f) a lateral opening within said central shaft wherein high pressure fluid in the passage can communicate directly with the counterbore in the rotating head to provide high pressure fluid to the at least one jet; and (g) spacer means to align the rotating head.

9. The invention of claim 8 wherein the spacer means comprise at least one ring-shaped washer positioned on said central shaft at the inlet side of said rotating head and on said central shaft at the outlet side of said rotating head between said rotating head and said housing means.

* * * * *